US005629121A

United States Patent [19]

Nakayama

[11] Patent Number: 5,629,121

[45] Date of Patent: May 13, 1997

[54] TONER FOR ELECTROPHOTOGRAPHY AND PROCESS FOR PRODUCING THE SAME

[75] Inventor: Koji Nakayama, Shizuoka, Japan

[73] Assignee: Tomoegawa Paper Co., Ltd., Tokyo, Japan

[21] Appl. No.: 560,370

[22] Filed: Nov. 17, 1995

[30] Foreign Application Priority Data

Nov. 25, 1994 [JP] Japan ..... 6-315539

[51] Int. Cl.[6] ..... G03G 9/087

[52] U.S. Cl. ..... 430/109; 430/110; 430/137

[58] Field of Search ..... 430/109, 110, 430/137

[56] References Cited

U.S. PATENT DOCUMENTS

| | | | |
|---|---|---|---|
| 4,863,824 | 9/1989 | Uchida et al. | 430/109 |
| 5,057,392 | 10/1991 | McCabe et al. | 430/109 |
| 5,147,747 | 9/1992 | Wilson et al. | 430/109 |
| 5,393,630 | 2/1995 | Bayley et al. | 430/137 |
| 5,480,756 | 1/1996 | Mahabadi et al. | 430/109 |
| 5,500,324 | 3/1996 | Mahabadi et al. | 430/137 |

*Primary Examiner*—Roland Martin

*Attorney, Agent, or Firm*—Cushman Darby & Cushman, IP Group of Pillsbury Madison & Sutro, LLP

[57] ABSTRACT

A toner for electrophotography is disclosed which includes at least a polyester resin and a colorant, the polyester resin including at least a saturated polyester resin having a melting initiation temperature of from 50° C. to less than 100° C., and a crosslinked polyester obtained by crosslinking an unsaturated polyester resin. The toner is highly safe and tenaciously fixable to receiving paper at low temperatures and causes no offset problem in practical use.

12 Claims, No Drawings

TONER FOR ELECTROPHOTOGRAPHY AND PROCESS FOR PRODUCING THE SAME

FIELD OF THE INVENTION

The present invention relates to a toner for electrophotography, in particular, an electrophotographic toner for use in a copier or printer which employs heated-roll fixing. The present invention also relates to a process for producing the toner.

BACKGROUND OF THE INVENTION

With the recent spread of the copiers and printers which are based on electrophotography, these copiers and printers have come to be required not only to be energy-saving (diminish power consumption) mainly for the purposes of spread to domestic use and increasing the number of copier or printer functions, but also to be operated at a higher speed for the purpose of spread to the so-called gray area located between printing machines and copiers. There also is a desire for a copier or printer which can be operated at a lower rolling pressure for the purpose of fixing-roll simplification for attaining a machine cost reduction. In addition, since copiers having a double-side-copying function or equipped with an automatic document feeder have spread widely with the trend toward shifting to higher-grade copiers, the electrophotographic toners for use in such copiers and printers are required to have a low fixing temperature, to be less apt to cause offset, and to be excellent in the strength of fixing to a receiving paper so as to avoid smearing during both-side copying or in the automatic document feeder.

To meet the requirements described above, the following prior art techniques including a binder resin having an improved molecular weight or improved molecular weight distribution have been proposed.

Specifically, an attempt has been made to employ a binder resin having a reduced molecular weight to thereby attain a lower fixing temperature. However, the reduction in molecular weight has also resulted in a reduced viscosity besides the lowered melting point, and this has caused the problem of offset to the fixing roll. To avoid this offset phenomenon, a technique of widening the molecular weight distribution of the binder resin has been proposed. For obtaining a polyester resin having a widened molecular weight distribution, a technique of using a polyfunctional monomer having a functionality of 3 or higher as a crosslinking ingredient has been employed. However, this technique has a problem that the increased crosslink density results in an increased melt viscosity and impaired fixability, although effective in preventing the offset phenomenon. Another drawback is that the glass transition temperature ($T_g$) of the resin should be lowered so as to impart sufficient fixability and this unavoidably impairs the storage stability of the toner. There is another technique for offset phenomenon prevention which comprises mixing a high-molecular polyester resin with a low-molecular polyester during melt kneading to thereby obtain a resin blend which has a widened molecular weight distribution for obtaining both anti-offset properties and fixability. This technique, however, has a drawback that since two resins having considerably different melt viscosities are kneaded together, a homogeneous dispersion comprising the two resins cannot be obtained and, hence, a combination of sufficient fixability and anti-offset properties is unable to be obtained.

SUMMARY OF THE INVENTION

An object of the present invention is to provide a toner for electrophotography which is fixable at a low fixing temperature, has no problem concerning anti-offset properties, and is excellent in the strength of fixing to receiving paper and in image characteristics.

The present invention provides a toner for electrophotography which comprises at least a polyester resin and a colorant, the polyester resin comprising a saturated polyester resin having a melting initiation temperature of from 50° C. to less than 100° C., and a crosslinked polyester obtained by crosslinking an unsaturated polyester resin.

The present invention further provides a process for producing a toner for electrophotography which comprises melt-kneading a mixture comprising at least a saturated polyester resin having a melting initiation temperature of from 50° C. to less than 100° C., an unsaturated polyester resin, a colorant, and a radical-polymerization catalyst to crosslink the unsaturated polyester resin with the aid of the radical polymerization catalyst during the melt kneading, subsequently pulverizing the kneaded mixture, and then classifying the resulting particles.

DETAILED DESCRIPTION OF THE INVENTION

The present invention is based on a technique of melt-kneading a low-melting saturated polyester resin together with an unsaturated polyester resin in the presence of a radical-polymerization catalyst to selectively crosslink the unsaturated polyester resin, thereby giving a polyester resin blend which has a wide molecular weight distribution and in which the low-melting saturated polyester resin contributes to fixing strength and the crosslinked polyester obtained from the unsaturated polyester resin serves to impart anti-offset properties. The low-melting saturated polyester resin should have a melting initiation temperature of from 50° C. to less than 100° C., so as to impart satisfactory low-temperature fixability. Melting initiation temperatures thereof lower than 50° C. are undesirable because a problem is caused concerning storage stability, while melting initiation temperatures thereof not lower than 100° C. are undesirable in that fixability is impaired. The term "melting initiation temperature" means the temperature at which the plunger of the following apparatus begins to descend under the following conditions.

Apparatus; Koka-type flow tester CF-500, manufactured by Shimadzu Corporation, Japan Conditions;

Plunger: 1 $cm^2$
Diameter of the die: 1 mm
Length of the die: 1 mm
Load: 20 kgF
Preheating temperature: 50°–80° C.
Preheating time: 300 sec
Heating rate: 6° C./min Examples of the diol component for the saturated polyester resin include polyoxypropylene (2,2)-2,2-bis(4-hydroxyphenyl)propane, polyoxypropylene(3,3)-2,2-bis(4-hydroxyphenyl)propane, polyoxyethylene(2,0)-2,2-bis(4-hydroxyphenyl)propane, polyoxypropylene(2,0)-polyoxyethylene(2,0)-2,2-bis(4-hydroxyphenyl)propane, polyoxypropylene(6)-2,2-bis(4-hydroxyphenyl)propane, ethylene glycol, 1,2-propylene glycol, 1,3-propylene glycol, 1,4-butanediol, neopentyl glycol, 1,5-pentanediol, and 1,6-hexanediol.

Examples of the diol component for the unsaturated polyester resin include 1,4-butenediol and 1,6-hexenediol.

Examples of trihydric and higher alcohols include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxybenzene.

Examples of the acid component include phthalic acid, isophthalic acid, terephthalic acid, cyclohexanedicarboxylic acid, adipic acid, sebacic acid, and malonic acid.

Examples of the unsaturated acid component include fumaric acid, maleic acid, maleic anhydride, citraconic acid, itaconic acid, succinic acid, alkenylsuccinic acids, and pentenedicarboxylic acid.

Examples of tricarboxylic and higher carboxylic acids include 1,2,4-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, tetra(methylenecarboxyl)methane, and 1,2,7,8-octanetetracarboxylic acid.

In the present invention, the saturated polyester resin is required to melt as sharply as possible at a low temperature, and is preferably a polymer of monomers comprising a divalent saturated alcohol ingredient and a divalent saturated carboxylic acid ingredient.

The unsaturated polyester resin is a polymer of monomers containing at least either of an unsaturated diol ingredient and an unsaturated acid ingredient such as those enumerated above, and the number average molecular weight of the unsaturated polyester resin is preferably from 1,000 to 20,000, more preferably from 3,000 to 10,000. The unsaturated polyester resin is preferably a polymer of monomers containing either a polyhydric alcohol having a functionality of 3 or higher or a polybasic carboxylic acid having a functionality of 3 or higher. The reason for this is that crosslinking a polyester resin already having a three-dimensional structure with the aid of a polymerization initiator easily attains not only a considerable increase in molecular weight but also a widened molecular weight distribution even though the number of crosslinking sites is small. In the toner of the present invention, the proportion of the crosslinked polyester obtained by crosslinking the unsaturated polyesters at their ethylenically unsaturated bonds is such that the amount of the crosslinked unsaturated polyester resin is usually desirably from 5 to 150 parts by weight, preferably from 5 to 80 parts by weight, especially preferably from 10 to 50 parts by weight, per 100 parts by weight of the saturated polyester resin.

An azo compound or an organic peroxide may be used as the radical-polymerization catalyst of the present invention. Of these, an organic peroxide is preferred from the standpoint of reactivity. Examples of the organic peroxide include ketone peroxides such as methyl ethyl ketone peroxide, cyclohexane peroxide, 3,3,5-trimethylcyclohexane peroxide, methylcyclohexane peroxide, methyl acetoacetate peroxide, and acetylacetone peroxide; peroxyketals such as 1,1-bis(t-butylperoxy)-3,3,5-trimethylcyclohexane, 1,1-bis(t-butylperoxy)cyclohexane, 2,2-bis(t-butylperoxy)octane, dibutyl 4,4-bis(t-butylperoxy)valeate, and 2,2-bis(t-butylperoxy)butane; hydroperoxides such as t-butyl hydroperoxide, cumene hydroperoxide, diisopropylbenzene hydroperoxide, p-methane hydroperoxide, 2,5-dimethylhexane 2,5-dihydroperoxide, and 1,1,3,3-tetramethylbutyl hydroperoxide; dialkyl peroxides such as di-t-butyl peroxide, t-butyl cumyl peroxide, dicumyl peroxide, α,α'-bis(t-butylperoxy-m-isopropyl)benzene, 2,5-dimethyl-2,5-di(t-butylperoxy)hexane, and 2,5-dimethyl-2,5-di(t-butylperoxy)hexane-3; acyl peroxides such as acetyl peroxide, isobutyl peroxide, octanoyl peroxide, decanoyl peroxide, lauroyl peroxide, 3,5,5-trimethylhexanoyl peroxide, succinic acid peroxide, benzoyl peroxide, 2,4-dichlorobenzoyl peroxide, and m-toluoyl peroxide; peroxydicarbonates such as diisopropyl peroxydicarbonate, di-2-ethylhexyl peroxydicarbonate, di-2-propyl peroxydicarbonate, bis(4-t-butylcyclohexyl) peroxydicarbonate, dimyristyl peroxydicarbonate, di-2-ethoxyethyl peroxydicarbonate, dimethoxyisopropyl peroxydicarbonate, di(3-methyl-3-methoxybutyl) peroxydicarbonate, and diallyl peroxydicarbonate; and peroxyesters such as t-butyl peroxyacetate, t-butyl peroxyisobutyrate, t-butyl peroxypivalate, t-butyl peroxyneodecanoate, cumyl peroxyneodecanoate, t-butyl peroxy-2-ethylhexanoate, t-butyl peroxy-3,5,5-trimethylhexanoate, t-butyl peroxylaurate, t-butyl peroxybenzoate, di-t-butyl peroxyisophthalate, 2,5-dimethyl-2,5-di(benzoylperoxy)hexane, t-butyl peroxymaleate, t-butyl peroxyisopropylcarbonate, cumyl peroxyoctoate, t-hexyl peroxypivalate, t-butyl peroxyneohexanoate, t-hexyl peroxyneohexanoate, and cumyl peroxyneohexanoate. The amount of the radical-polymerization catalyst added in the present invention is preferably from 0.1 to 10 parts by weight per 100 parts by weight of the unsaturated polyester resin.

A reactive monomer may be added in crosslinking the unsaturated polyester resin in this invention so as to produce a crosslinked polyester containing the monomer as a crosslinking ingredient. This crosslinked polyester is preferred in that it has a long crosslinking-site distance and increased elasticity to attain improved fixing strength and a widened non-offset temperature range. A vinyl compound may be used as the reactive monomer. Examples thereof include monovinyl compounds such as styrene and derivatives thereof, e.g., α-methylstyrene and chlorostyrene, acrylic esters, e.g., methyl acrylate, ethyl acrylate, propyl acrylate, butyl acrylate, octyl acrylate, and other alkyl acrylates; methacrylic esters, e.g., methyl methacrylate, ethyl methacrylate, propyl methacrylate, butyl methacrylate, octyl methacrylate, stearyl methacrylate, glycidyl methacrylate, and other alkyl methacrylates; and other monovinyl compounds including acrylonitrile, maleic acid, maleic esters, vinyl chloride, vinyl acetate, vinyl benzoate, vinyl methyl ketone, vinyl hexyl ketone, vinyl methyl ether, vinyl ethyl ether, and vinyl isobutyl ether. Also usable are divinyl compounds such as divinylbenzene, ethylene glycol methacrylate, diethylene glycol dimethacrylate, diethylene glycol acrylate, neopentyl glycol diacrylate, and 1,6-hexanediol dimethacrylate; trivinyl compounds such as trimethylolethane trimethacrylate, trimethylolpropane triacrylate, and trimethylolpropane trimethacrylate; and tetravinyl compounds such as tetramethylolmethane tetraacrylate and tetramethylolmethane tetramethacrylate. The added amount of the reactive monomer is preferably from 0.5 to 2 mole, more preferably from 0.8 to 1.2 mole per mole of an unsaturated group contained in the unsaturated polyester resin.

A crosslinking accelerator may also be used in this invention. Use of the accelerator enables the crosslinking reaction to be completed in a reduced time period at a low temperature. Namely, kneading can be carried out quickly, or production efficiency can be improved.

Examples of the crosslinking accelerator include metal soaps such as cobalt naphthenate, manganese naphthenate, and vanadium octylate; amines such as dimethylaniline, phenylmorpholine, diethylenetriamine, triethylenetetramine, tetraethylene-pentamine, diethylaminopropylamine, m-phenylenediamine, diaminodiphenylmethane, diaminodiphenyl sulfone, m-xylene diamine, m-aminobenzylamine, benzidine, 4-chloro-o-phenylenediamine, bis(3,4-diaminophenyl) sulfone, and 2,6-diaminopyridine; phosphorus compounds such as phenylphosphinic acid; and metal chelate compounds such as vanadylacetyl-acetonate and aluminum acetylacetonate.

Besides the ingredients described above, a binder resin other than polyesters, a magnetic material, and property modifiers such as a charge control agent and a fluidizing agent may be used in the toner of the present invention.

Examples of binder resins which may be incorporated into the electrophotographic toner of this invention besides the polyester resins described above include epoxy resins, silicone resins, polyamide resins, and polyurethane resins.

Examples of the colorants for use in the toner for electrophotography of the present invention include carbon black, Nigrosine dyes, aniline blue, Chalco Oil Blue, chrome yellow, ultramarine blue, Dupont Oil Red, quinoline yellow, methylene blue chloride, phthalocyanine blue, malachite green oxalate, lamp black, Rose Bengal, and mixtures thereof. These colorants should be incorporated in a proportion sufficient for forming a visible image having a sufficient density. The proportion thereof is usually about from 1 to 20 parts by weight per 100 parts by weight of the binder resin.

Examples of the magnetic material include ferromagnetic metals, alloys, or compounds of iron, cobalt, nickel, etc., such as ferrite and magnetite; alloys which contain no ferromagnetic elements but become ferromagnetic upon an appropriate heat treatment, such as the alloys containing manganese and copper and called Heusler alloys, e.g., manganese-copper-aluminum alloys and manganese-copper-tin alloys; and chromium dioxide. These magnetic materials are evenly dispersed into the binder resin in the form of a fine powder having an average particle diameter of from 0.1 to 1 μm. The content of the magnetic material is generally from 20 to 70% by weight, preferably from 40 to 70% by weight, based on the amount of the toner.

The toner for electrophotography of the present invention, which has the composition described above, preferably has a melting initiation temperature (defined above) of from 60° C. to less than 100° C. If the melting initiation temperature thereof is not less than 100° C., fixability is liable to be insufficient. If the melting initiation temperature thereof is lower than 60° C., anti-blocking properties may be impaired to cause a problem concerning storage stability.

The toner for electrophotography of the present invention is mixed with a carrier comprising a ferrite powder, an iron powder, or the like, giving a two-component developer. In the case where the toner contains a magnetic material, the toner may be used not as a mixture with a carrier but as it is as a one-component developer for the development of electrostatic images, or may be used as a two-component developer after being mixed with a carrier. The toner of this invention is also applicable to development with a non-magnetic one-component developer.

In producing the toner of the present invention, an unsaturated polyester resin is crosslinked during melt kneading to heighten the molecular weight thereof. As a result, the toner obtained contains the crosslinked unsaturated polyester resin evenly dispersed therein to attain excellent anti-offset properties. More particularly, in the first step of this toner production process, at least a saturated polyester resin, an unsaturated polyester resin, a colorant, and a radical-polymerization catalyst are mixed along with, if any, other necessary additive ingredients, using a Henschel mixer or the like to obtain a mixture, which is then melt-kneaded. Usable melt-kneading devices include a roll mill, a pressure kneader, a Banbury mixer, and an extruder. Melt-kneading conditions are suitably selected according to the composition, and are not particularly limited. For example, melt-kneading conditions for obtaining a preferred crosslinked polyester using a pressure kneader include a resin temperature of from 130° to 150° C. and a kneading time of from 10 to 30 minutes. The kneaded mixture is pulverized with a pulverizer such as a jet mill or a turbo mill, and the resulting particles are classified with an air classifier to prepare a toner having a desired particle diameter distribution. The particle diameter distribution is preferably from 5 to 20 μm.

The present invention will be explained below by reference to Examples. In these Examples, all parts are by weight.

EXAMPLE 1

Synthesis of Saturated Polyester Resin:

Polycondensation was conducted using an alcohol ingredient consisting of 40 mol % polyoxypropylene 2,2-2,2-bis (4-hydroxyphenyl)propane and 60 mol % polyoxyethylene (2,0) 2,2-bis(4-hydroxyphenyl)propane and an acid ingredient consisting of 100 mol % terephthalic acid. Thus, saturated polyester resin A having a peak molecular weight of 4,500, a $T_g$ of 63° C. and a melting initiation temperature of 85° C. was obtained.

Synthesis of Unsaturated Polyester Resin:

Polycondensation was conducted using an alcohol ingredient consisting of 85 mol % propylene oxide adduct of bisphenol A and 15 mol % trimethylolpropane, an acid ingredient consisting of 100 mol % fumaric acid, and a slight amount of hydroquinone. Thus, unsaturated polyester resin B having a peak molecular weight of 7,500, a $T_g$ of 57° C. and a melting initiation temperature of 90° C. was obtained.

| | |
|---|---|
| Saturated polyester resin A | 60 parts |
| Unsaturated polyester resin B | 40 parts |
| Benzoyl peroxide | 0.2 parts |
| Carbon black (trade name, MA-100; manufactured by Mitsubishi Kasei Corporation) | 6.5 parts |
| Metallized dye containing chromium (trade name, S-34; manufactured by Orient Chemical Industries, Ltd.) | 2 parts |
| Polypropylene (trade name, Viscol 330P; manufactured by Sanyo Chemical Industries, Ltd.) | 3 parts |

The ingredients specified above were mixed together in the proportion shown above with a supermixer. The resulting mixture was thermally melted and kneaded with a twin-screw extruder, pulverized with a jet mill, and then classified in a dry state with an air classifier to obtain toner particles having an average particle diameter of 10 μm. A mixture of 100 parts of the thus-obtained toner particles and 0.4 parts of hydrophobic silica (trade name, Cab-O-Sil TS-530; manufactured by Cabot Corp.) was agitated with a Henschel mixer for 1 minute to adhere the hydrophobic silica to the surface of the particles. Thus, a toner for electrophotography according to the present invention was obtained, which had a melting initiation temperature of 98.5° C.

EXAMPLE 2

| | |
|---|---|
| Saturated polyester resin A | 80 parts |
| Unsaturated polyester resin B | 20 parts |
| Benzoyl peroxide | 0.2 parts |
| Carbon black (trade name, MA-100; manufactured by Mitsubishi Kasei Corporation) | 6.5 parts |
| Metallized dye containing chromium (trade name, S-34; manufactured by Orient Chemical Industries, Ltd.) | 2 parts |
| Polypropylene (trade name, Viscol 330P; manufactured by Sanyo Chemical Industries, Ltd.) | 3 parts |

The ingredients specified above were mixed together in the proportion shown above with a supermixer. The resulting mixture was thermally melted and kneaded with a twin-screw extruder, pulverized with a jet mill, and then classified in a dry state with an air classifier to obtain toner particles having an average particle diameter of 10 μm. A mixture of 100 parts of the thus-obtained toner particles and 0.4 parts of hydrophobic silica (trade name, Cab-O-Sil TS-530; manufactured by Cabot Corp.) was agitated with a Henschel mixer for 1 minute to adhere the hydrophobic silica to the surface of the particles. Thus, a toner for electrophotography according to the present invention was obtained, which had a melting initiation temperature of 89.9° C.

EXAMPLE 3

| | |
|---|---|
| Saturated polyester resin A | 80 parts |
| Unsaturated polyester resin B | 20 parts |
| Benzoyl peroxide | 0.2 parts |
| Divinylbenzene | 2 parts |
| Carbon black (trade name, MA-100; manufactured by Mitsubishi Kasei Corporation) | 6.5 parts |
| Metallized dye containing chromium (trade name, S-34; manufactured by Orient Chemical Industries, Ltd.) | 2 parts |
| Polypropylene (trade name, Viscol 330P; manufactured by Sanyo Chemical Industries, Ltd.) | 3 parts |

The ingredients specified above were mixed together in the proportion shown above with a supermixer. The resulting mixture was thermally melted and kneaded with a twin-screw extruder, pulverized with a jet mill, and then classified in a dry state with an air classifier to obtain toner particles having an average particle diameter of 10 μm. A mixture of 100 parts of the thus-obtained toner particles and 0.4 parts of hydrophobic silica (trade name, Cab-O-Sil TS-530; manufactured by Cabot Corp.) was agitated with a Henschel mixer for 1 minute to adhere the hydrophobic silica to the surface of the particles. Thus, a toner for electrophotography according to the present invention was obtained, which had a melting initiation temperature of 92.1° C.

EXAMPLE 4

| | |
|---|---|
| Saturated polyester resin A | 80 parts |
| Unsaturated polyester resin B | 20 parts |
| Benzoyl peroxide | 0.2 parts |
| Divinylbenzene | 2 parts |
| Cobalt naphthenate | 0.4 parts |
| Carbon black (trade name, MA-100; manufactured by Mitsubishi Kasei Corporation) | 6.5 parts |
| Metallized dye containing chromium (trade name, S-34; manufactured by Orient Chemical Industries, Ltd.) | 2 parts |
| Polypropylene (trade name, Viscol 330P; manufactured by Sanyo Chemical Industries, Ltd.) | 3 parts |

The ingredients specified above were mixed together in the proportion shown above with a supermixer. The resulting mixture was thermally melted and kneaded with a twin-screw extruder, pulverized with a jet mill, and then classified in a dry state with an air classifier to obtain toner particles having an average particle diameter of 10 μm. A mixture of 100 parts of the thus-obtained toner particles and 0.4 parts of hydrophobic silica (trade name, Cab-O-Sil TS-530; manufactured by Cabot Corp.) was agitated with a Henschel mixer for 1 minute to adhere the hydrophobic silica to the surface of the particles. Thus, a toner for electrophotography according to the present invention was obtained, which had a melting initiation temperature of 95.4° C.

EXAMPLE 5

| | |
|---|---|
| Saturated polyester resin A | 40 parts |
| Unsaturated polyester resin B | 60 parts |
| Benzoyl peroxide | 0.2 parts |
| Divinylbenzene | 2 parts |
| Cobalt naphthenate | 0.4 parts |
| Carbon black (trade name, MA-100; manufactured by Mitsubishi Kasei Corporation) | 6.5 parts |
| Metallized dye containing chromium (trade name, S-34; manufactured by Orient Chemical Industries, Ltd.) | 2 parts |
| Polypropylene (trade name, Viscol 330P; manufactured by Sanyo Chemical Industries, Ltd.) | 3 parts |

The ingredients specified above were mixed together in the proportion shown above with a supermixer. The resulting mixture was thermally melted and kneaded with a twin-screw extruder, pulverized with a jet mill, and then classified in a dry state with an air classifier to obtain toner particles having an average particle diameter of 10 μm. A mixture of 100 parts of the thus-obtained toner particles and 0.4 parts of hydrophobic silica (trade name, Cab-O-Sil TS-530; manufactured by Cabot Corp.) was agitated with a Henschel mixer for 1 minute to adhere the hydrophobic silica to the surface of the particles. Thus, a toner for electrophotography according to the present invention was obtained, which had a melting initiation temperature of 102.7° C.

Comparative Example 1

A comparative toner for electrophotography was obtained in the same manner as in Example 1, except that benzoyl peroxide as a radical-polymerization catalyst was not used. This toner had a melting initiation temperature of 87.3° C.

Comparative Example 2

A comparative toner for electrophotography was obtained in the same manner as in Example 1, except that unsaturated polyester resin B was not used and the amount of saturated polyester resin A was changed to 100 parts. This toner had a melting initiation temperature of 84.6° C.

Comparative Example 3

A comparative toner for electrophotography was obtained in the same manner as in Example 1, except that saturated polyester resin A was not used and the amount of unsaturated polyester resin B was changed to 100 parts. This toner had a melting initiation temperature of 113.1° C.

The toners obtained in the Examples and Comparative Examples given above were evaluated with respect to the following items.

(1) Non-offset Temperature Range

Four parts of each of the electrophotographic toners obtained in the Examples and Comparative Examples was mixed with 96 parts of a resin-uncoated ferrite carrier (trade name, FL-1020; manufactured by Powder Tec Co.) to prepare a two-component developer. This developer was used in a commercially available copier (trade name, SF-9800; manufactured by Sharp Corporation, Japan) to form unfixed rectangular images each having a width of 2 cm and a length of 5 cm on A4-size receiving paper.

The unfixed toner images thus formed on the receiving paper were then fixed using a fixing apparatus having a pair of fixing rolls consisting of a heated roll having a surface layer made of Teflon and a pressure roll having a surface layer made of a silicone rubber. This fixing apparatus was operated at a rolling pressure of 1 kg/cm$^2$ and a rolling speed of 50 mm/sec, while gradationally varying the surface temperature of the heated roll 5° C. by 5° C. The copies thus obtained at each surface temperature of the heated roll were examined for toner smears in the margin. The range of temperatures at which smear-free copies were obtained is referred to as the non-offset temperature range.

(2) Non-offset Temperature Range Width

The difference between the maximum and minimum temperatures in the non-offset temperature range is referred to as the non-offset temperature range width.

(3) Fixing Strength

Using the fixing apparatus described above, the unfixed toner images described above were fixed to the receiving paper at a surface temperature of the heated roll of 140° C. A cotton pad was then rubbed against the thus-formed fixed images, and the fixing strength as a measure of low-energy fixability was calculated using the following equation. The image densities were measured with reflective densitometer RD-914, manufactured by Macbeth Co.

$$\text{Fixing strength (\%)} = \frac{\text{Density of fixed image after rubbing}}{\text{Density of fixed image before rubbing}} \times 100$$

The results of the above evaluations are shown in Table below. With respect to the toner images obtained from the toners of Comparative Examples 1 and 2, the evaluation of fixing strength was omitted because of the occurrence of offset.

TABLE

| Example No. | Non-offset Temperature Range (°C.) | Non-offset Temperature Range Width (°C.) | Fixing Strength (%) | Melting Initiation Temperature of Toner (°C.) |
|---|---|---|---|---|
| Example 1 | 120–200 | 80 | 80.1 | 98.5 |
| Example 2 | 110–190 | 80 | 95.8 | 89.9 |
| Example 3 | 115–195 | 80 | 90.4 | 92.1 |
| Example 4 | 120–205 | 85 | 87.2 | 95.4 |
| Example 5 | 130–210 | 80 | 75.5 | 102.7 |
| Comparative Example 1 | none | 0 | — | 87.3 |
| Comparative Example 2 | none | 0 | — | 84.6 |
| Comparative Example 3 | 140–210 | 70 | 60.5 | 113.1 |

As apparent from the test results summarized in Table, the electrophotographic toners of the present invention were ascertained to retain a non-offset temperature range width of from 80° to 85° C., which is sufficient for practical use. It was also ascertained that the toners according to the present invention exhibited a fixing strength at 140° C. of 75% or higher, which is sufficient for practical use.

In contrast, the toners of Comparative Examples 1 and 2 caused offset throughout the whole test temperature range, while the toner of Comparative Example 3 had a 140° C. fixing strength as low as 70% or below. Thus, these comparative toners were ascertained to cause a problem in practical use.

The developers prepared in evaluation (1) described above each was subjected to a copying test in which 10,000 copies were continuously produced using a commercially available copier (trade name, BD-3801, manufactured by Toshiba Corp., Japan). As a result, with respect to each of the developers of Examples 1 to 5, the amount of friction charge was within the range of from −20 μc/g to −25 μc/g throughout the copies of from the 1st to the 10,000th copies, and the image density was within the range of from 1.45 to 1.40 throughout the copies of from the 1st to the 10,000 copies. Thus, those developers were ascertained to cause no problems in practical use. The original used in this copying test was an A4-size original having a percentage of black parts of 6%. The amount of friction charge was measured with a blow-off type apparatus for measuring the amount of friction charge manufactured by Toshiba Chemical Corp., Japan. The image density was measured with reflective densitometer RD-914, manufactured by Macbeth Co.

The toner for electrophotography of the present invention has the effects of retaining a sufficient non-offset temperature range and being fixable at low temperatures, excellent in fixing strength, and capable of giving a large number of copies having a sufficient image density.

While the invention has been described in detail and with reference to specific embodiments thereof, it will be apparent to one skilled in the art that various changes and modifications can be made therein without departing from the spirit and scope thereof.

What is claimed is:

1. A toner for electrophotography which comprises a polyester resin and a colorant, the polyester resin comprising a saturated polyester resin having a melting initiation temperature of from 50° C. to less than 100° C., and a crosslinked polyester resin formulated from an unsaturated polyester crosslinked at the ethylenic unsaturation of the unsaturated polyester.

2. A toner according to claim 1, wherein said toner contains from 5 to 150 parts by weight of said crosslinked polyester resin per 100 parts by weight of the saturated polyester resin.

3. A toner for electrophotography according to claim 1, wherein said toner has a melting initiation temperature of from 60° C. to less than 100° C.

4. A process for producing a toner for electrophotography which comprises:

melt-kneading a mixture comprising a saturated polyester resin having a melting initiation temperature of from 50° C. to less than 100° C., an unsaturated polyester resin formulated from an unsaturated polyester crosslinked at the ethylenic unsaturation of the unsaturated polyester, a colorant, and a radical-polymerization catalyst to crosslink the unsaturated polyester with the aid of the radical polymerization catalyst during the melt kneading, subsequently pulverizing the kneaded mixture, and then classifying the resulting particles.

5. A toner for electrophotography according to claim 1, further comprising a radical polymerization catalyst for crosslinking the unsaturated polyester.

6. A toner for electrophotography which comprises a polyester resin and a colorant, the polyester resin comprising a saturated polyester resin having a melting initiation temperature of from 50° C. to less than 100° C., and a crosslinked polyester resin formulated from an unsaturated polyester and a reactive monomer radically polymerized with an ethylenic unsaturation of the unsaturated polyester.

7. A toner according to claim 6, wherein said radical monomer is selected from the group consisting of a compound containing at least one vinyl group, a compound containing at least one acrylic group, a compound containing at least one (meth)acrylate group, and a compound containing at least one acrylate group.

8. A toner according to claim 6, wherein said radical monomer is selected from the group consisting of a compound containing at least two vinyl groups, a compound containing at least two acrylic groups, a compound containing at least two (meth)acrylate groups, and a compound containing at least two acrylate groups.

9. A toner according to claim 6, wherein said radical monomer is a compound containing at least two vinyl groups.

10. A toner according to claim 9, wherein said radical monomer is divinylbenzene.

11. A toner for electrophotography which comprises a polyester resin and a colorant, the polyester resin consisting essentially of a saturated polyester resin having a melting initiation temperature of from 50° C. to less than 100° C., and a crosslinked polyester resin formulated from an unsaturated polyester crosslinked at the ethylenic unsaturation of the unsaturated polyester.

12. A toner for electrophotography which comprises a polyester resin and a colorant, the polyester resin consisting essentially of a saturated polyester resin having a melting initiation temperature of from 50° C. to less than 100° C., and a crosslinked polyester resin formulated from an unsaturated polyester and a reactive monomer radically polymerized with an ethylenic unsaturation of the unsaturated polyester.

* * * * *